US005078298A

United States Patent [19]

Omori

[11] Patent Number: 5,078,298

[45] Date of Patent: Jan. 7, 1992

[54] PARTS FEEDING APPARATUS

[75] Inventor: Shigenori Omori, Uozu, Japan

[73] Assignee: Yoshida Kogyo K.K., Tokyo, Japan

[21] Appl. No.: 575,488

[22] Filed: Aug. 29, 1990

[30] Foreign Application Priority Data

Aug. 31, 1989 [JP] Japan ..... 1-102293

[51] Int. Cl.[5] ..... B65G 59/00

[52] U.S. Cl. ..... 221/123; 221/133; 221/204; 221/236; 221/239

[58] Field of Search ..... 221/11, 104–106, 221/123–124, 133, 204, 224, 236, 239, 251, 296–298; 29/809

[56] References Cited

U.S. PATENT DOCUMENTS

| | | | |
|---|---|---|---|
| 425,209 | 4/1890 | Carpenter | 221/124 X |
| 918,886 | 4/1909 | Mills | 221/188 |
| 1,300,219 | 4/1919 | Mack | 221/188 |
| 2,934,238 | 4/1960 | Henderson et al. | 221/36 |
| 3,575,316 | 4/1971 | Bianchi | 221/133 |
| 3,956,812 | 5/1976 | Kawakami et al. | 29/207.5 SL |
| 4,049,155 | 9/1977 | Kawakami et al. | 221/192 |
| 4,662,053 | 5/1987 | Aceti et al. | 221/200 |
| 4,941,795 | 7/1990 | Elliott et al. | 221/106 |

FOREIGN PATENT DOCUMENTS

| | | |
|---|---|---|
| 167046 | 1/1906 | Fed. Rep. of Germany . |
| 529022 | 3/1977 | Japan . |
| 55-49163 | 12/1980 | Japan . |
| 1051361 | 12/1966 | United Kingdom . |
| 2107570 | 5/1983 | United Kingdom . |

*Primary Examiner*—David H. Bollinger
*Attorney, Agent, or Firm*—Hill, Van Santen, Steadman & Simpson

[57] ABSTRACT

A parts feeding apparatus is disclosed for use in feeding a supply of garment appliance parts such as buttons, hooks, slide fastener component parts and the like from parts reservoirs or parts feeders through a plurality of feed chutes onto a parts applying holder. The feed chutes each carrying thereon an array of parts of different types and colors are pivotally movable in the same plane into and out of an operative position relative to the parts applying holder, in which position the parts are selectively transferred onto the holder.

3 Claims, 7 Drawing Sheets

PARTS FEEDING APPARATUS

BACKGROUND OF THE INVENTION

1. Field of the Invention

This invention relates to an apparatus for feeding garment appliance parts such as slide fastener component parts, buttons, hooks and the like, and has particular reference to an apparatus for feeding such parts of different types or colors successively and selectively one at a time for application onto a garment article.

2. Prior Art

There are known certain apparatuses designed to selectively feed and apply garment parts by switching one supply chute to another. One such apparatus is disclosed in Japanese Patent Publication No. 55-49163 in which there are provided a plurality of guide tracks collectively merged at a single chute connected to a parts applying means and a switching means selectively transferring parts such as male and female buttons to the respective tracks. Since the switching means is located at a midpoint of the tracks, it would become necessary to remove those button parts which have previously been accumulated in the lower or downstream portion of each track prior to operation of the switching means. In other words, the switching between the tracks cannot be readily effected unless the residue of unwanted parts on each of the tracks in cleared out.

Another prior apparatus is disclosed in Japanese Patent Publication No. 52-9022 in which a parts feed chute is removably mounted in place between a parts feeder and a parts holder so that the chute can be dismounted for removal of any residual unwanted parts for exchange with a supply of wanted parts. This exchanging operation is tedious and time-consuming as it requires interruption of the apparatus operation.

SUMMARY OF THE INVENTION

It is therefore a primary object of the present invention to provide an apparatus for feeding garment appliance parts which will eliminate the foregoing difficulties of the prior art and which will enable selective feeding of parts of different types or colors from a parts reservoir to an applying station effectively and efficiently without interrupting the apparatus operation.

The above and other objects and features of the invention will appear clear from the following detailed description taken in conjunction with the accompanying drawings.

According to the invention, there is provided a parts feeding apparatus which comprises a plurality of parts feeders storing garment appliance parts of different types or colors; a plurality of feed chutes carrying rows of the parts and connected at one of their ends to the parts feeders, the feed chutes being pivotally movable in the same plane; a vertically movable parts applying holder having a parts transfer pocket; and a chute drive means adapted to provide a pivotal movement of the feed chutes to bring the latter selectively into and out of an operative position relative to the parts applying holder in which parts are moved into the pocket.

DETAILED DESCRIPTION OF THE INVENTION

Figure 1:
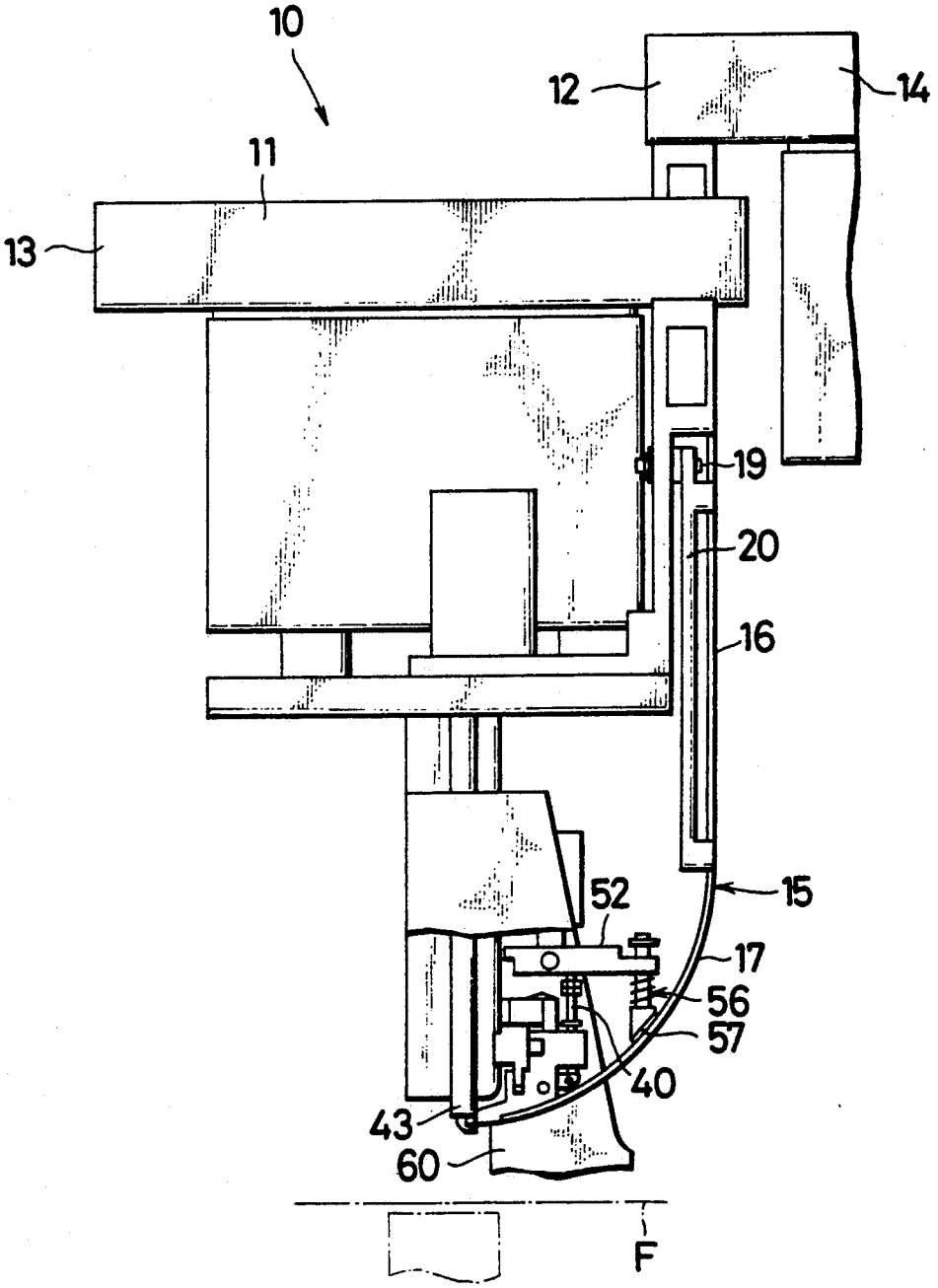
FIG. 1 is a front elevational view of a parts feeding apparatus embodying the invention incorporating a plurality of feed chutes.
Figure 2:
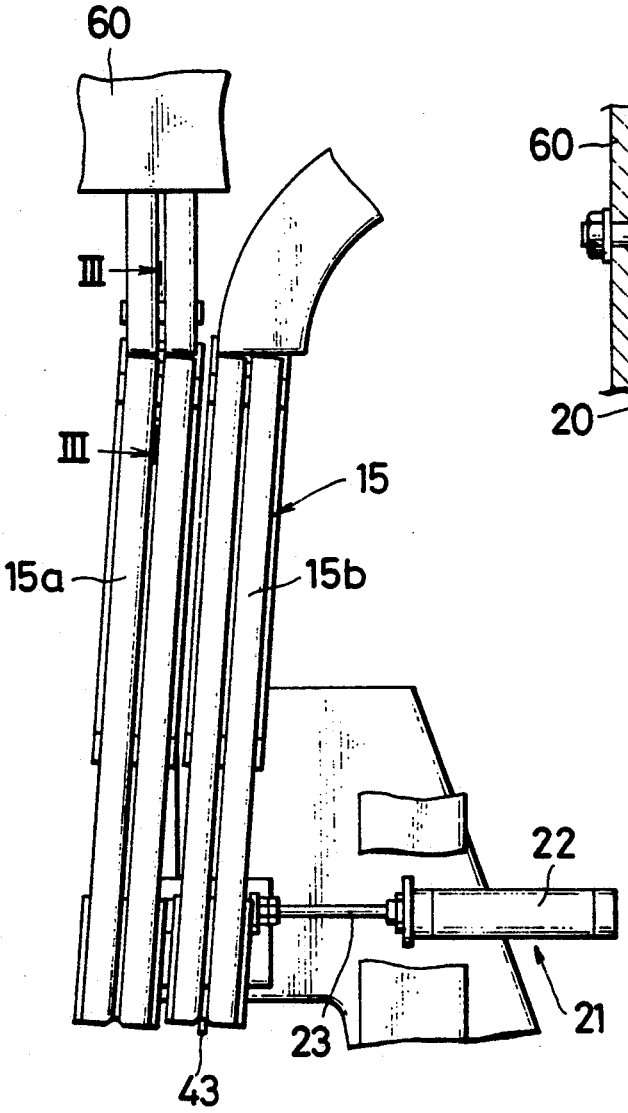
FIG. 2 is a side elevational view in part of the apparatus of FIG. 1.

Referring now to the drawings and FIG. 1 in particular, there is shown a parts feeding apparatus generally designated 10 which comprises a plurality of parts feeder 11, 12 storing therein garment appliance parts of different types or colors such as bottom end stops P for a slide fastener and equipped with for example with vibrating bowls 13, 14, respectively, for orienting a multiplicity of end stops P into aligned arrays for gravity sliding movement in and along a plurality of feed chutes 15. The parts feeders 11, 12 are conventional and well known and hence will require no further explanation.

Figure 10:
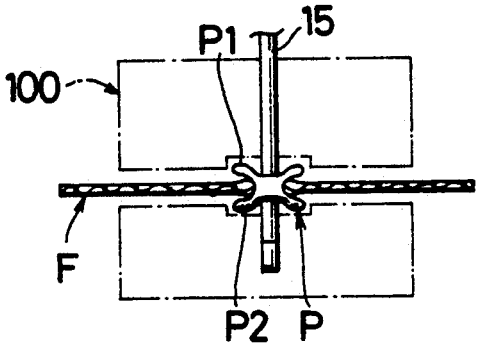
FIG. 10 is a diagrammatic view showing the end stop placed in a punch.
Figure 11:
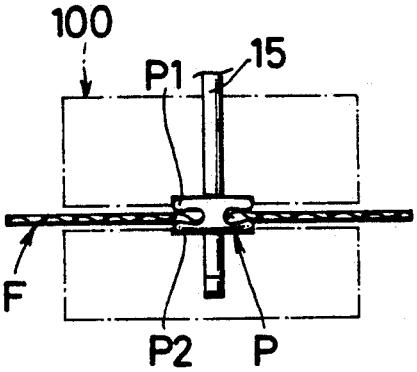
FIG. 11 is a view similar to FIG. 10 but showing the end stop clamped onto a fastener stringer.
Figure 12:
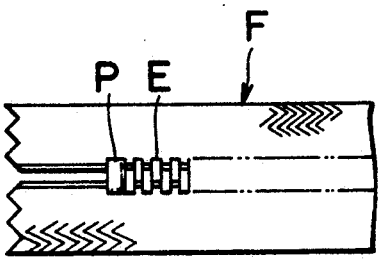
FIG. 12 is a plan view of a portion of a fastener stringer having the end stop clamped thereon.

Only two of feed chutes 15 are shown for purposes of illustration but they may be as many as operationally feasible for feeding garment parts which are shown conveniently to be bottom end stops P having different forms or colors. The illustrated bottom end stop P has a cross sectionally "H" configuration with upper and lower arms P1 and P2 which are clamped by a punch 100 onto a fastener stringer F as shown in FIGS. 10 and 11. The end stop P is secured in place at a bottom end portion of the fastener stringer F as shown in FIG. 12, so as to restrict the movement thereat of a slider not shown in a manner well known in the art. The color of the end stop P may be gold or silver, as a matter of example, to be harmonious with the color of a row of fastener coupling elements E.

Figure 3:
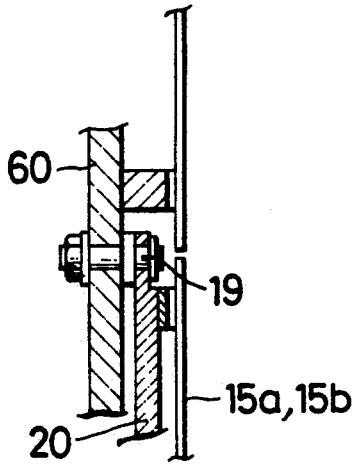
FIG. 3 is a cross-sectional view on enlarged scale taken on the line III—III of FIG. 2.

Now, there are illustrated two parallel feed chutes 15*a* and 15*b* each having a straight vertical portion 16, an arcuate portion 17 merging integrally therewith and a track 18 extending longitudinally centrally of and through both portions 16 and 17 for slidably receiving and transporting bottom end stops P supplied from the respective parts feeders 11 and 12. Each of the feed chutes 15*a* and 15*b* is pivotally connected at its one or upper end to a support frame 60 by means of a pivotal pin 19 extending through and interconnecting a support bracket 20, to which the chute 15*a* 15*b*) is secured, as better shown in FIG. 3.

Figure 6:
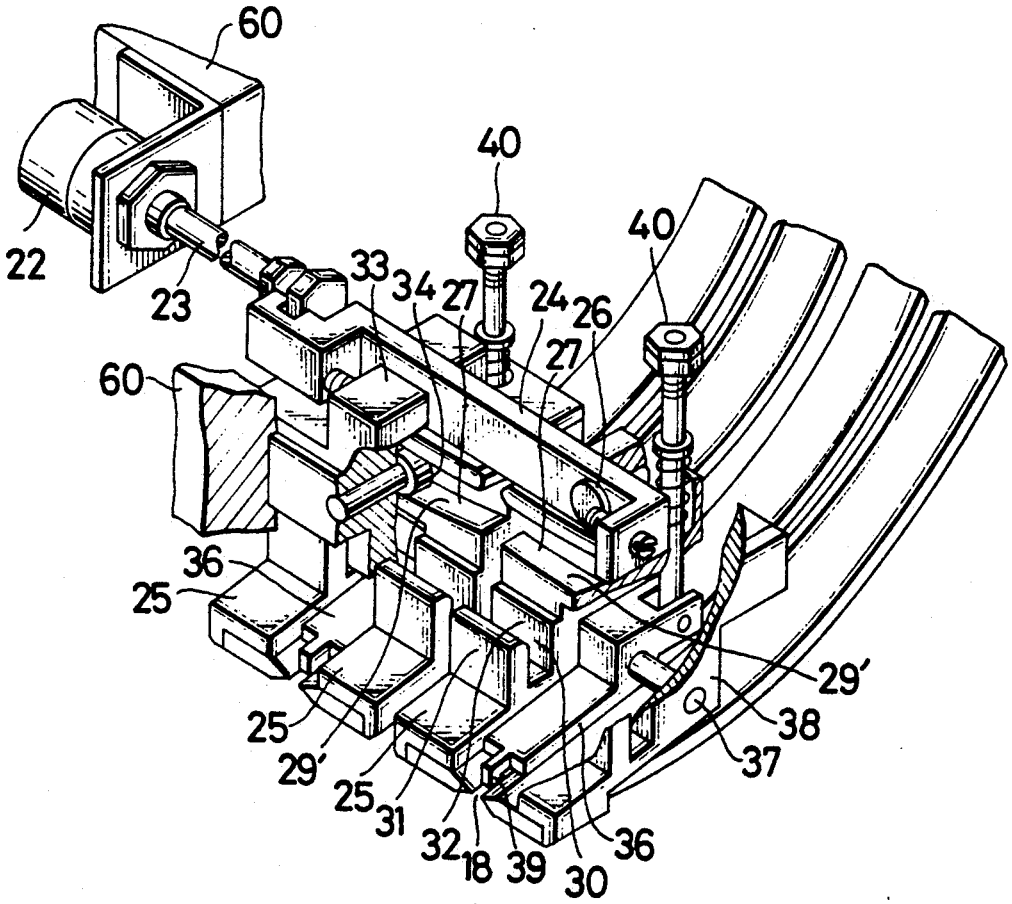
FIG. 6 is a perspective view of a chute drive means providing a pivotal movement of the chutes.

The chute 15*a* and 15*b* are moved pivotably or rockably about their respective pins 19 in the same plane by means of a chute drive means 21. As shown in FIG. 6, the drive means 21 is preferably in the form of a pneumatically operated cylinder 22 having a piston rod 23 operatively connected to a connecting bracket 24. A stroke of the piston rod 23 is determined such that the feed chutes 15*a*, 15*b* are selectively moved in either direction into and out of operative position relative to a parts applying holder later described. The other or lower end of each of the feed chutes 15*a* and 15*b* is connected to a chute holder 25 which is in turn connected at one of its ends by a pin 26 to the connecting bracket 24.

Each chute holder 25 has a first cavity 27 defined by upper and lower horizontal walls 28 and 29 having concavely contoured or arcuate surfaces 28' and 29' and a second cavity 30 defined by two parallel vertical walls 31 and 32.

A guide block 33 secured to the support frame 60 is provided with a guide roll 34 receptive in the first cavity 27 and slidably engageable between the arcuate surfaces 28' and 29' of the chute holder 25 and further with an integral downwardly projecting lug 35 receptive in the second cavity 30 and slidably engageable between the vertical walls 31 and 32 of the chute holder 25 as the latter is moved by the drive means 21.

The arcuate surfaces 28' and 29' of each chute holder 25 have a radius of curvature corresponding to the distance between the guide roll 34 and the pivotal pin 19 to which the feed chute 15 is pivotally connected, such that the feed chute 15 can move pivotally or rockably with a minimum of frictional resistance.

Designated at 36 is a retainer arm extending midpart between the chute holder 25 and pivotally connected at one of its ends through a pin 37 to a support block 38. The retainer arm 36 has a hook portion 39 at its other or free end disposed in alignment with the track 18 of the feed chute 15 for releasably holding a leading one P' of bottom end stops P in a row transported on the feed chute 15*a* or 15*b*.

Figure 7:
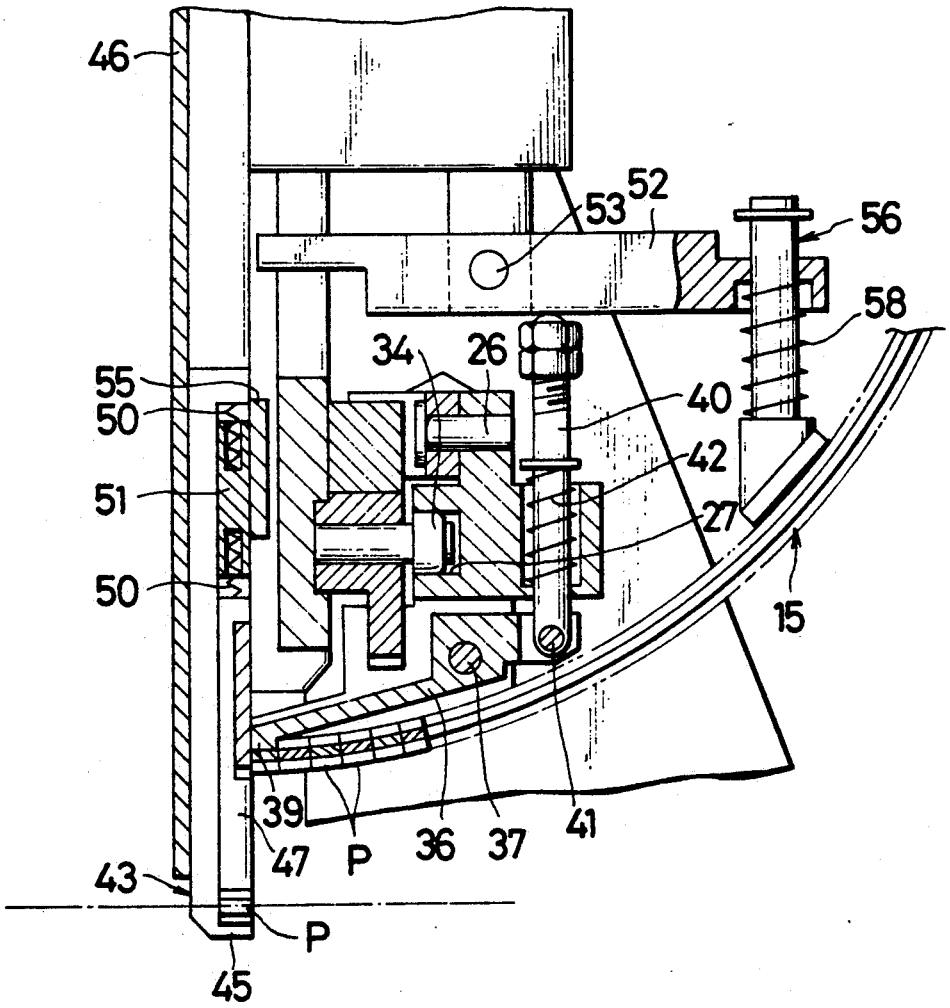
FIG. 7 is a front elevational, partly sectional view showing a parts transfer holder in one phase of operation relative to the chutes.

A vertical operating rod 40 has one or lower end thereof connected by a pin 41 to the retainer arm 36 and a compression spring 42 wound thereon for normally urging the retainer arm 36 counterclockwise to hold its hook portion 39 in abutting relation to the leading bottom end stop P' as shown in FIG. 7.

Figure 8:
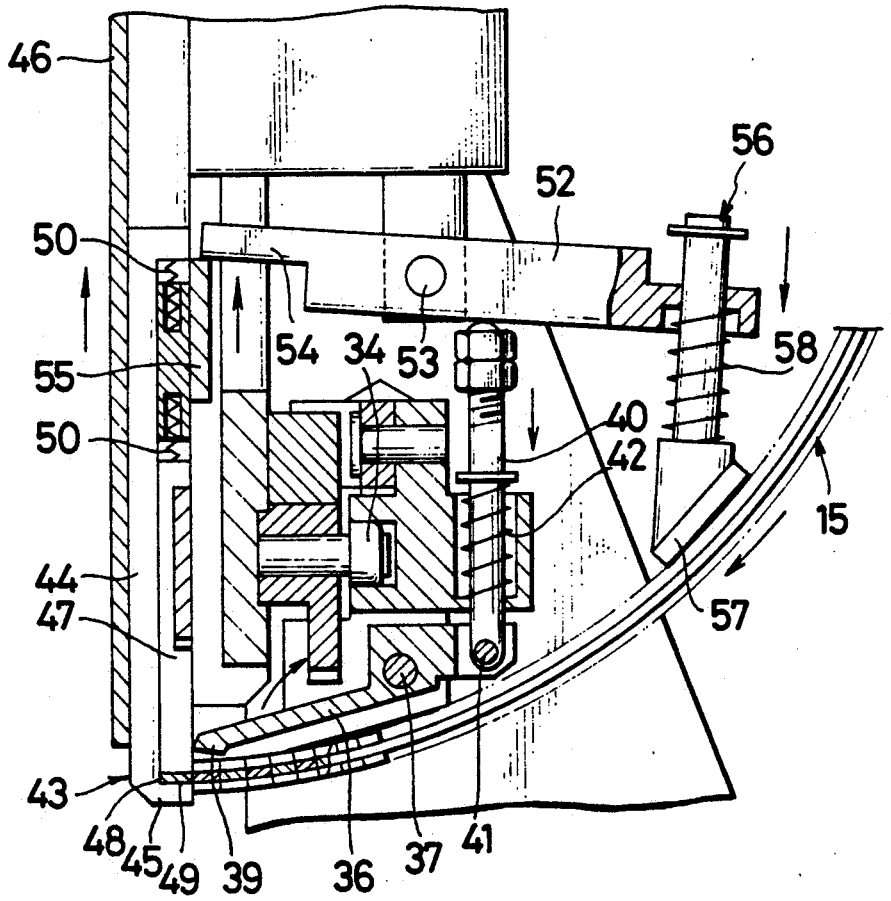
FIG. 8 is a view similar to FIG. 7 showing the parts transfer holder in another phase of operation.
Figure 9:
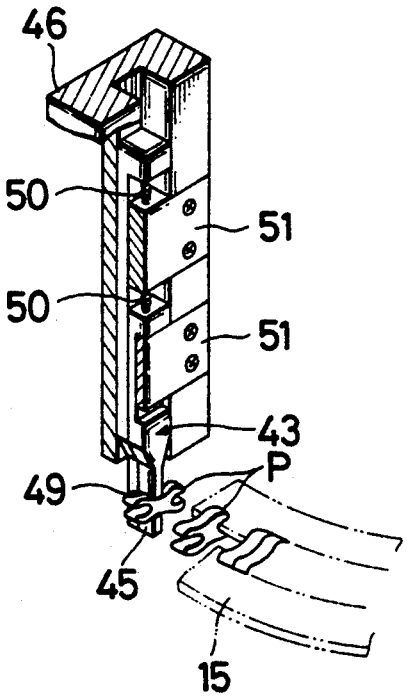
FIG. 9 is a perspective view, partly sectional of the parts transfer holder shown receiving and holding a slide fastener end stop thereon.

A parts applying holder 43 is vertically movable and comprises a first vertical guide member 44 having a horizontally projecting jaw 45 at its lower end and secured to a casing 46 and a second vertical companion guide member 47 vertically movable relative to the first guide member 44 and having a clamping surface 48 at its lower end which defines with the jaw 45 a parts transfer pocket 49 (FIGS. 7 and 8) for releasably holding a bottom end stop P. The second guide members 47 is resiliently held by a pair of springs 50, 50 accommodated in brackets 51, 51 secured to the casing 46 as shown in FIG. 9.

A horizontally extending lever 52 is pivotally connected by a pin 53 and has an offset abutment 54 at one of its ends which is engageable with an abutting lug 55 formed on the second guide member 47 of the parts applying holder 34. The other or opposite end of the lever 52 is connected to a vertical parts pusher 56 having a presser foot 57 resiliently held relative to the feed chute 15 by means of a compression spring 58, the arrangement being that when the parts applying holder 43 is moved upwardly from the position shown in FIG. 7 to the position in FIG. 8 by a pneumatic cylinder or other suitable drive means not shown, the abutting lug 55 abuts against the offset abutment 54 thereby allowing the lever 52 to rotate clockwise about the pin 53 and hence urging the pusher 56 downward against the tension of the spring 58, whereupon the presser foot 57 engages and pushes forward the row of bottom end stops P on the chute 15 and at the same time the vertical operating rod 40 is urged downward in contact with the lever 52, allowing the retainer arm 36 to rotate clockwise with its hook portion 39 lifted apart from the leading bottom end stop P'. This permits the leading bottom end stop P' to move into the pocket 49 of the parts applying holder 43 as shown in FIG. 8. This is followed by descending the parts applying holder 3 back to the position of FIG. 7 in which the pocket 49 registers with the path of fastener stringer chain F, whereupon the bottom end stop P in the pocket 49 is transferred and clamped onto the chain F as illustrated in FIGS. 10–12.

Figure 4:
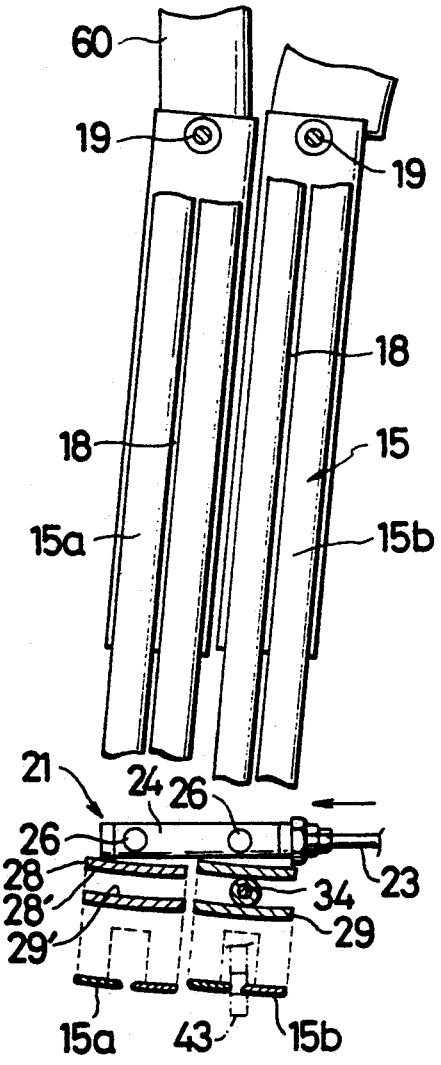
FIG. 4 is a side elevational view showing a pair of feed chutes in one operative position.
Figure 5:
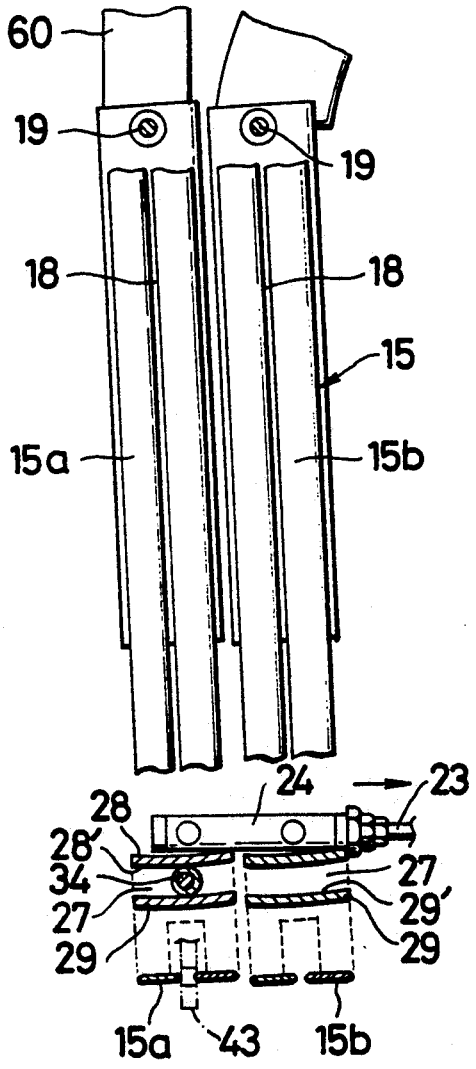
FIG. 5 is a view similar to FIG. 4 but showing the feed chutes in another operative position.

Selective feeding and application of parts, i.e. bottom end stops P for slide fasteners, are effected by actuating the chute drive means; namely, the cylinder 22 so that forward and reverse strokes of its piston rod 23 bring the beed chutes 15*a* and 15*b* alternately into operative position relative to the parts applying holder 43 as shown in FIGS. 4 and 5 in which the leading bottom end stop P' is transferred onto the pocket 49 of the parts applying holder 43.

The stroke of the piston rod 25 is of course variable in accordance with the number of feed chutes 15 to be installed as appears obvious to those skilled in the art.

Obviously, various modifications and variations of the present invention are possible in the light of the above teaching. It is therefore to be understood that within the scope of the appended claims the invention may be practiced otherwise than as specifically described.

What is claimed is:

1. A parts feeding apparatus which comprises:

(a) a plurality of parts feeders storing garment appliance parts of different types of colors;

(b) a plurality of feed chutes carrying rows of said parts and connected at one of their ends to said parts feeders, said feed chutes being pivotally movable in the same plane;

(c) a vertically movable parts applying holder having a parts transfer pocket;

(d) means for moving said parts into said pockets; and (e) a chute drive means adapted to provide a pivotal movement of said feed chutes to bring the latter selective into and out of an operative position relative to said parts applying holder in which parts are moved into said pocket.

2. A parts feeding apparatus according to claim 1 wherein said drive means is a pneumatically operated cylinder.

3. A parts feeding apparatus according to claim 1 wherein each of said feed chutes has a straight vertical portion and an arcuate portion merging integrally therewith, said vertical position being connected by a pivotal pin about which said feed chute is pivotally movable.

* * * * *